US007347644B2

(12) United States Patent
Meyers

(10) Patent No.: US 7,347,644 B2
(45) Date of Patent: Mar. 25, 2008

(54) MULTI-USE ADAPTER RING FOR STACKABLE RISER COMPONENTS FOR ON-SITE WASTE SYSTEMS

(75) Inventor: Theodore W. Meyers, Barrington, IL (US)

(73) Assignee: Tuf-Tite, Inc., Lake Zurich, IL (US)

( * ) Notice: Subject to any disclaimer, the term of this patent is extended or adjusted under 35 U.S.C. 154(b) by 94 days.

(21) Appl. No.: 11/197,019

(22) Filed: Aug. 4, 2005

(65) Prior Publication Data

US 2007/0031190 A1 Feb. 8, 2007

(51) Int. Cl.
*E02D 29/12* (2006.01)
*E02D 29/14* (2006.01)

(52) U.S. Cl. ..... 404/25; 52/19

(58) Field of Classification Search ..... 52/19, 52/20; 404/25, 26

See application file for complete search history.

(56) References Cited

U.S. PATENT DOCUMENTS

| | | | | |
|---|---|---|---|---|
| 537,182 | A | 4/1895 | Brown | |
| 871,977 | A | 11/1907 | Winslow | |
| 1,258,839 | A | 3/1918 | Wheeler | |
| 1,469,459 | A | 10/1923 | Quigley | |
| 1,712,510 | A | 5/1929 | Monie | |
| 1,793,038 | A | 2/1931 | Zimmermann | |
| 2,110,788 | A | 3/1938 | Brauer | |
| 2,111,462 | A | 3/1938 | Simpson | |
| 2,344,206 | A | 3/1944 | Forni | |
| 2,545,577 | A | 3/1951 | Griffin | |
| 2,593,918 | A * | 4/1952 | Redman | 404/26 |
| 2,661,019 | A * | 12/1953 | Snyder et al. | 137/594 |
| 3,134,264 | A | 5/1964 | Miller | |

(Continued)

FOREIGN PATENT DOCUMENTS

| | | |
|---|---|---|
| DE | 1 964 319 | 7/1971 |

(Continued)

OTHER PUBLICATIONS

Polylok, Inc. brochure entitled "Polylok's New Super Risers" (understood to be published in Apr. 2002).

(Continued)

*Primary Examiner*—Raymond W Addie
(74) *Attorney, Agent, or Firm*—Marshall, Gerstein & Borun LLP

(57) ABSTRACT

A multi-use adapter ring for converting the compatibility of an access opening of an underground on-site waste or drainage facility tank surface or component so as to receive a lower end of a riser component, in a tongue-and-groove type connection, to help achieve and maintain a vacuum tight, water-tight seal. The multi-use adapter ring has a first vertical cylindrical wall, a second vertical cylindrical wall having a height less than the first vertical cylindrical wall and spaced radially outwardly from the first vertical cylindrical wall, and a plurality of radially-extending ribs arranged between the first and second vertical cylindrical walls. An inner ledge is provided inwardly of the first vertical cylindrical wall. The first vertical cylindrical wall defines a male connection end to engage, in a substantially vacuum-tight manner, a female connection end of a riser component, such as a riser, a riser pan, or a riser cover.

20 Claims, 18 Drawing Sheets

U.S. PATENT DOCUMENTS 3,230,674 A 1/1966 Christensen
3,259,248 A * 7/1966 Wiegand ..... 210/487
3,385,012 A 5/1968 Lovegreen
3,596,419 A 8/1971 Jalbert
3,611,889 A 10/1971 Levinson
3,772,826 A 11/1973 Ferver
3,883,005 A 5/1975 Stevens
3,908,933 A * 9/1975 Goss et al. ..... 244/3.21
3,920,347 A 11/1975 Sauriol et al.
4,023,590 A 5/1977 Harris et al.
4,038,789 A 8/1977 Axgarde et al.
4,089,139 A * 5/1978 Moffa et al. ..... 52/20
4,111,807 A * 9/1978 Boomus et al. ..... 73/864.03
4,121,390 A 10/1978 Hall et al.
4,187,647 A 2/1980 Hall
4,188,151 A 2/1980 Hall
4,197,031 A 4/1980 Hild
4,410,099 A 10/1983 de Larosiere
4,472,911 A 9/1984 Jooris et al.
4,508,469 A 4/1985 Dumortier
4,508,470 A 4/1985 Ferns
4,553,876 A 11/1985 Arntyr et al.
4,593,714 A 6/1986 Madden
4,659,251 A 4/1987 Petter et al.
4,663,036 A 5/1987 Strobl, Jr. et al.
4,759,656 A 7/1988 Wilson
4,772,154 A 9/1988 Caroulle
4,828,274 A 5/1989 Stannard
4,842,443 A 6/1989 Argandona
4,852,757 A 8/1989 Gold
4,960,149 A 10/1990 Rizzitiello
4,978,023 A 12/1990 Behlmann et al.
4,997,562 A 3/1991 Warner
4,998,387 A 3/1991 Geiger
5,038,540 A 8/1991 Krautz
5,044,818 A 9/1991 Pritchard
5,046,886 A 9/1991 Muir et al.
5,076,456 A 12/1991 Geyer
5,114,271 A 5/1992 Sunderhaus et al.
5,205,668 A * 4/1993 Adams ..... 404/26
5,263,298 A 11/1993 Ballesteros
5,362,175 A 11/1994 Begin
5,366,317 A 11/1994 Solimar
5,385,326 A 1/1995 Bidwell
5,386,669 A 2/1995 Almeida
5,462,386 A * 10/1995 Prescott ..... 404/26
5,470,172 A * 11/1995 Wiedrich ..... 404/25
5,513,926 A 5/1996 Prescott
5,525,006 A 6/1996 Kilman et al.
5,535,908 A 7/1996 Sheu
5,536,110 A * 7/1996 Tompkins et al. ..... 404/25
5,542,780 A 8/1996 Kourgli
5,549,411 A 8/1996 Hawkins
5,564,855 A * 10/1996 Anderson ..... 404/26
5,617,679 A * 4/1997 Meyers ..... 52/20
5,653,559 A 8/1997 Stieb et al.
5,669,523 A 9/1997 Mueller et al.
5,800,648 A * 9/1998 House et al. ..... 156/71
5,852,901 A 12/1998 Meyers
6,047,724 A 4/2000 Nurse, Jr.
6,088,972 A 7/2000 Johanneck
6,161,984 A * 12/2000 Sinclair ..... 404/25
6,195,944 B1 3/2001 Goldthorpe
6,196,760 B1 * 3/2001 Sinclair ..... 404/26
6,484,451 B1 11/2002 Gavin
6,688,072 B1 * 2/2004 Gavin ..... 52/742.14
2003/0145527 A1 * 8/2003 Meyers ..... 52/20

FOREIGN PATENT DOCUMENTS

EP 0 866 179 9/1998
GB 1 507 106 4/1978
GB 1 599 409 5/1978
GB 2 185 053 A 7/1987
GB 2 301 848 12/1996

OTHER PUBLICATIONS

Digital photos of American Manufacturing Company, Manassas, Virginia, "Distribution Box", "Box Riser" (extension and flange), "Box Riser SL" (extension and flange assembled), understood to be on sale at least as early as Jan. 1, 2001.
American Manufacturing Company, Inc., catalog entitled "American On-Site Products," Oct. 1989 (pp. 3, 4, 5, and 10).
Applicant acknowledges the use of the clay tile or cement chimney flues as risers over septic tanks, more than a year before Aug. 30, 2004.
Applicant acknowledges the use of lengths of pipe as risers over septic tanks, more than a year before Aug. 30, 2004.
Brochure for Tuf-Tite Effluent Filters, 2003 (publicly available before Oct. 15, 2003).
Zabel Online Store, http://store.yahoo.com/zabelstore/access-systems.html, (showing RB-RTA-20×2 Retrofit Tank Adapter understood to be on sale more than one year before Oct. 15, 2004; and AS-R-AR (Polylok, Inc.) Adapter Ring, understood to be on sale more than one year before Oct. 15, 2004).
The Zabel Zone, Spring 1999, pp. 60, 61 and 77 (showing Zeus™ Access System, including RB-TA-T-26×2).
Digital photos of ZeusTM Access System, Zabel, Retrofit Tank Adapter, understood to be on sale more than one year before Oct. 15, 2004.
Digital photos of Polylok, Inc. Adapter Ring, understood to be on sale more than one year before Oct. 15, 2004.

* cited by examiner

MULTI-USE ADAPTER RING FOR STACKABLE RISER COMPONENTS FOR ON-SITE WASTE SYSTEMS

FIELD OF THE DISCLOSURE

This disclosure relates generally to components forming modular passageways for gaining access to septic tanks and other on-site, underground waste and drainage structures, and more specifically, a multi-use adapter ring for converting the compatibility of an access opening of an underground on-site waste or drainage facility tank surface or component so as to receive a lower end of a riser component, in a tongue-and-groove type connection, to help achieve and maintain a vacuum tight, water-tight seal.

BACKGROUND

Stackable risers, such as disclosed in U.S. Pat. Nos. 5,617,679 and 5,852,901, assigned to Tuf-Tite, Inc., the assignee of the present disclosure, provide modular solutions to gaining access from at or near grade level to underground septic tanks and other underground on-site waste and drainage units. Another stackable riser component, known as a riser pan, was disclosed in co-pending U.S. patent application Ser. No. 10/352,086, Publication No. US 2003/0145527 A1, also assigned to Tuf-Tite, Inc. In order for the stackable risers and riser pans to be used with access opening(s) of concrete septic tanks or other concrete on-site waste units, it was typical to cast a lowermost riser or riser pan into the concrete lid of the tank.

As used herein, the term "concrete lid" of the septic tank refers to the large, horizontally-oriented concrete slab, typically on the order of 4 feet by 8 feet and several inches thick, for example, provided at the top of the septic tank (having a typical capacity from about 750 to about 1,250 gallons, with some septic tanks having a capacity of about 1,500 gallons or more), and supported by the walls of the septic tank. The term "concrete cover", as used herein, refers to the well-known removable, generally smaller (and typically round) cover member associated with an opening in the concrete lid and used to gain access to the interior of the septic tank. Such concrete covers are generally flat, have cylindrically-shaped outer peripheral walls, while others may have tapered walls, or may include a stepped wall portion. The concrete covers sit atop the concrete lid, over the lid's access opening, or in a frustro-conical portion of a riser pan. These concrete covers allow a point of access to the interior of the septic tanks for purposes of inspection, drainage, cleaning, or other maintenance, including access to effluent filters provided at the inlet or outlet of the septic tank, such as for cleaning or replacement of the filters.

Septic tanks and other underground on-site waste or drainage facilities need not be made of concrete. For example, plastic septic tanks, such as formed of polyethylene, having a capacity of about 1,000 to about 1,500 gallons, are increasingly prevalent. Smaller plastic underground structures, with a capacity of about 300 to about 500 gallons, are also available, and are used, for example, as so-called pump stations or lift stations.

Access to the interior of all these various concrete or plastic structures is necessary from time to time for maintenance, repairs, cleaning, filter replacement, and the like. Manholes or similar access means have been provided in these structures to provide such interior access. However, since the access means for these structures are often buried at least several inches, and more often several feet, below grade level, it is desirable to provide an access column of one or more risers, whether formed of concrete or plastic, above the access means to avoid having to dig down to reach the access means.

A column of risers is preferably capped by a riser cover. It is conventional for a column of plastic risers to be capped by a plastic riser cover. By providing a riser pan within the column at some point therealong, it is possible for a secondary cover, such as a concrete cover, to be provided within a column of risers. Alternatives to risers include corrugated polyethylene pipe and ribbed PVC pipe.

It is desirable for a column of risers and an underground septic tank or other tank-type structure to be water-tight. One reliable manner of testing the ability of these structures to retain water is to test their capacity to maintain a vacuum. Those riser components that are formed to have a tongue-and-groove connection, including a female connecting portion having a downwardly-open, i.e. inverted, generally U-shaped cylindrical channel for connecting to a lower riser component, and a male cylindrical connection at an upper end for being received in the female connection of a next-higher riser component, are found to be capable of maintaining a suitable vacuum when formed into a column. A suitable vacuum-tight interconnection between a lowermost riser component and a manhole or other access means is therefore desirable.

Instead of having to cast a lowermost riser or riser pan into a concrete lid of a concrete septic tank, it would be desirable to provide an adapter on top of a concrete lid in a manner that accepts a lower connecting portion of a riser or riser pan, in a suitably vacuum-tight manner, and which adapter can be suitably sealed to the concrete lid. It would further be desirable if that same adapter could be used in place of riser interfaces conventionally employed at the access opening of roto-molded or blow-molded plastic tanks. For instance, known roto-molded or blow-molded plastic tanks have used blow-molded plastic risers with interlocking lugs at the bottom of at least a lowermost riser, which interlocking lugs are received in complementary slots in the vicinity of the access opening of the tank. Alternatively, some blow-molded plastic tanks have been molded so as to provide a threaded portion in the vicinity of the access opening, and a complementary threaded portion on a connecting end of a riser to be received thereon. As the lowermost riser is rotated with respect to the access opening of the tank, the lugs or threads serve to lock the risers in position. However, such risers have limited versatility, as they typically can only be used with a single manufacturer's tank system. Furthermore, risers typically used with such blow-molded or roto-molded plastic tanks have not achieved an adequate water-tight, vacuum-tight seal with adjacent risers, or with the access opening of the tank. Epoxy kits offered by certain plastic tank manufacturers for use in securing a lowermost riser at the access opening of blow-molded plastic tanks have likewise not achieved a sufficient vacuum-tight seal with the lowermost riser.

It is also desirable to convert corrugated polyethylene pipe, ribbed PVC pipe, concrete risers, and other risers lacking a tongue-and groove connection, to be compatible with risers having a tongue-and-groove connection (which achieves significantly greater vacuum-tightness as opposed to other riser connections). It would also be desirable to make manholes and other access means of concrete, plastic, and fiberglass underground septic tanks and other waste structures, drainage structures, pumping stations, or lift stations to be compatible with such substantially vacuum-tight risers having a general tongue-and-groove connection.

It would also be desirable to provide an adapter ring that would enable a flat surface of, for example, a concrete lid of a septic tank to accept stackable riser components without having to cast into, or drill holes into, the flat surface.

Thus, there is a need for a single form of multi-use adapter component that will efficiently convert the access opening, so as to accept a vertical stack of riser components in a substantially water-tight and substantially vacuum-tight arrangement, for any of a plurality of applications, such as (by way of example only) a concrete septic tank, a plastic (e.g., blow-molded or roto-molded) tank, a fiberglass tank, a pumping station, a lift station, a plastic riser, a concrete riser, a length of corrugated pipe, or a length of ribbed PVC pipe.

SUMMARY

A multi-use adapter ring having a flat, or generally planar, bottom, and a male cylindrical connecting portion, is employed to convert a flat exposed surface surrounding an access aperture, such as a manhole or similar access means, of an underground septic tank, pumping station, lift station, or a top of a riser or riser pan, to accept a female connector of a riser component, such as a riser, a riser pan, or a riser cover, of a type having a tongue-and-groove style interconnection. The multi-use adapter ring may be made of injection molded plastic, and gas assist molding processes may be employed. The exposed flat surface should have a diameter corresponding to at least the outer diameter of the adapter ring, and be free of obstacles preventing flat mating contact between the flat surface and a bottom of the adapter ring. This provides adequate surface area for an adhesive, such as butyl mastic rope, to bond the adapter ring to the flat surface, including in a substantially water-tight and substantially vacuum-tight seal.

An outer upright cylindrical wall having a first height, extends about an outer perimeter of the adapter ring, and an inner upright cylindrical wall, having a second height preferably greater than the first height, extends about an inner perimeter of the adapter ring. It is this inner upright wall which includes the male cylindrical connecting portion. A plurality of radially-extending ribs connect the inner and outer upright cylindrical walls, so as to create an integral, strong overall unit, providing proper reinforcement support of the inner upright wall which carries the riser stack above it. At least some of the plurality of radially-extending ribs are provided in pairs, each pair consisting of two of the radially-extending ribs spaced in sufficiently close proximity to one another to securely receive a threaded fastener inserted therebetween. Preferably, certain of the pairs of radially-extending ribs have a height substantially equal to a height of the lower of the inner and outer upright cylindrical walls. Other of the pairs of radially-extending ribs preferably have a height substantially less than the height of the lower of the inner and outer upright cylindrical walls, so as to provide adequate clearance between a head of a threaded fastener and a leg of a female connector of a riser component positioned immediately above the adapter ring.

The higher of the pairs of radially-extending ribs are provided to securely receive threaded fasteners projecting through screw bosses provided adjacent a female connector of a riser component positioned immediately above the adapter ring. These higher pairs of radially-extending ribs may also define a contact surface for a leg of the riser component positioned immediately above the adapter ring. The lower of the pairs of radially-extending ribs are provided to receive threaded fasteners intended to extend through the flat bottom of the adapter ring, so as to help secure the adapter ring to the underlying flat surface, such as at a mouth of the manhole or similar access means in an underground septic tank, or on a riser or length of corrugated polyethylene pipe or ribbed PVC pipe. When a threaded fastener is fully tightened between one of the lower pairs of radially-extending ribs, the head of the fastener is preferably lower than the height of the lower of the inner and outer cylindrical walls.

Instead of or in addition to the lower of the pairs of radially-extending ribs, screw bosses may be provided on an upper surface of the flat bottom of the adapter ring. Like the lower of the pairs of radially-extending ribs, the screw bosses provide locations for securing fasteners through the flat bottom of the adapter ring so as to help secure the adapter ring to the underlying flat surface.

In order to optimize strength and rigidity of the adapter ring while using minimal materials, it is desirable to employ gas assist molding techniques in the manufacture of the adapter ring. These and other aspects of the multi-use adapter ring of this disclosure are explained at greater length in the following detailed description of the preferred embodiments.

DETAILED DESCRIPTION OF THE PREFERRED EMBODIMENTS

Figure 1:
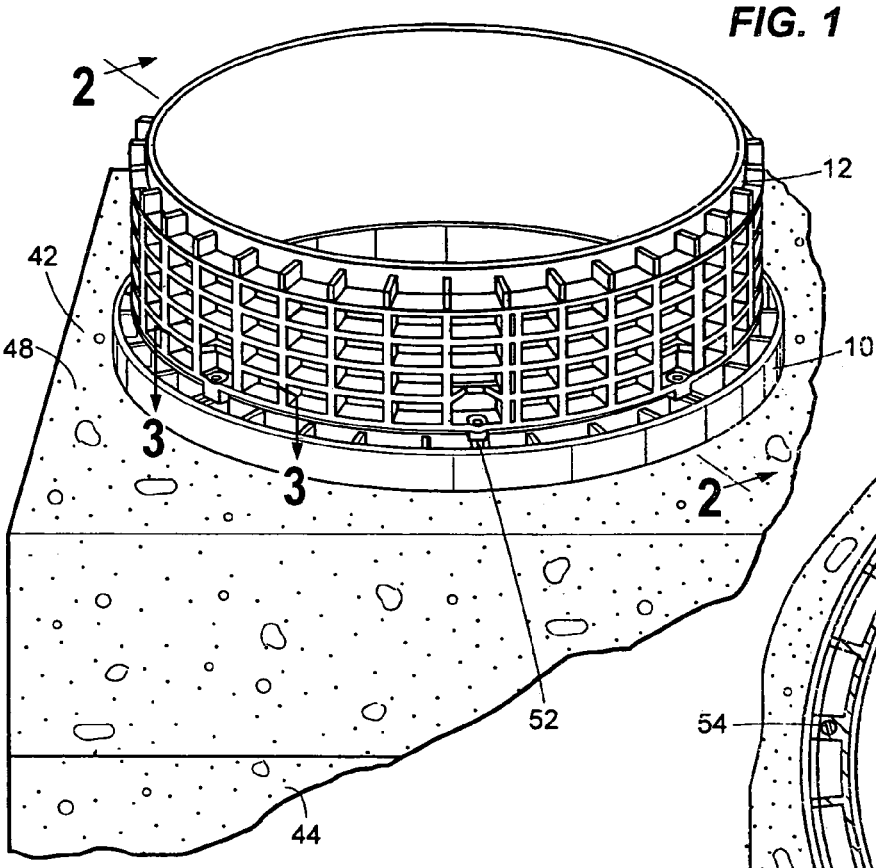
FIG. 1 is a perspective view of a multi-use adapter ring of the present disclosure disposed on top of a concrete lid of a septic tank, broken away, showing a lowermost riser of a stack of risers received on the adapter ring.
Figure 3:
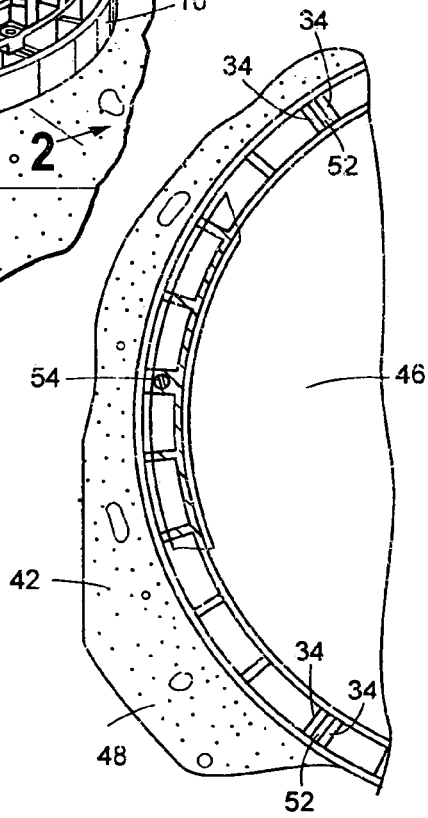
FIG. 3 is a cross-section view taken along lines 3-3 of FIG. 1.

The compatibility of a variety of components found in underground drainage systems, on-site waste systems, and other environments can be converted, by way of a multi-use adapter ring 10, to accept a riser component, such as a riser 12, a riser pan 14, or a riser cover 16, having a tongue-and-groove connection to achieve a substantially vacuum-tight seal. It is found that many of the components that would benefit by conversion to compatibility with these substantially vacuum-tight riser components have exposed flat surfaces at or near a mating edge of the component. Thus, a multi-use adapter ring 10 having a flat or substantially flat (i.e., generally planar) bottom can be secured to the exposed flat surface of a wide variety of such components desired to be so converted.

In order to connect with a female connection end 18 of a riser component, the multi-use adapter ring 10 includes a male cylindrical connecting portion 20. The male cylindrical connecting portion 20 includes a vertical cylindrical wall 22, a portion of which is received in an inverted, generally U-shaped channel 24 which forms the female connection end 18 of the riser component. An inner ledge 26 is provided on an inner surface 28 of the vertical cylindrical wall 22. A purpose of the inner ledge 26 is to provide support to part of a female connection end 18 of a riser component, as explained below.

The multi-use adapter ring 10 is also provided with an outer vertical cylindrical wall 32 which does not extend as high as the vertical cylindrical wall 22. A plurality of radially-extending ribs 34 connect the outer vertical cylindrical wall 32 to the vertical cylindrical wall 22. The radially-extending ribs 34 preferably are of a height no greater than a height of the outer vertical cylindrical wall 32.

The inner ledge 26 extends from a bottom 30 of the multi-use adapter ring 10 to a height $H_l$. The difference between the overall height of the vertical cylindrical wall 22 and the height $H_l$ of the inner ledge 26 is no greater than, and preferably somewhat less than, a length $H_i$ of an inner leg 36 of the inverted, generally U-shaped cylindrical channel 24. The difference between the overall height of the vertical cylindrical wall 22 and a height $H_r$ of the radially-extending ribs 34 is also no greater than, and preferably somewhat less than, a length $H_o$ of an outer leg 38 of the inverted, generally U-shaped cylindrical channel 24.

Preferably, the heights of the vertical cylindrical wall 22, the inner ledge 26, and the radially-extending ribs 34, relative to the heights of the inner and outer legs 36, 38, are such that when a riser component having a female connection end 18 is placed on the male cylindrical connecting portion 20 of the multi-use adapter ring 10, the inner leg 36 of the inverted, generally U-shaped cylindrical channel 24 contacts the inner ledge 26 and the outer leg 38 contacts the radially-extending ribs 34. Such contact between the inner leg 36 and the inner ledge 26, as well as between the outer leg 38 and the radially-extending ribs 34, efficiently transmits forces from the riser component, through the multi-use adapter ring 10, and to the exposed surface of the underlying component on which the multi-use adapter ring 10 is provided.

Figure 5:
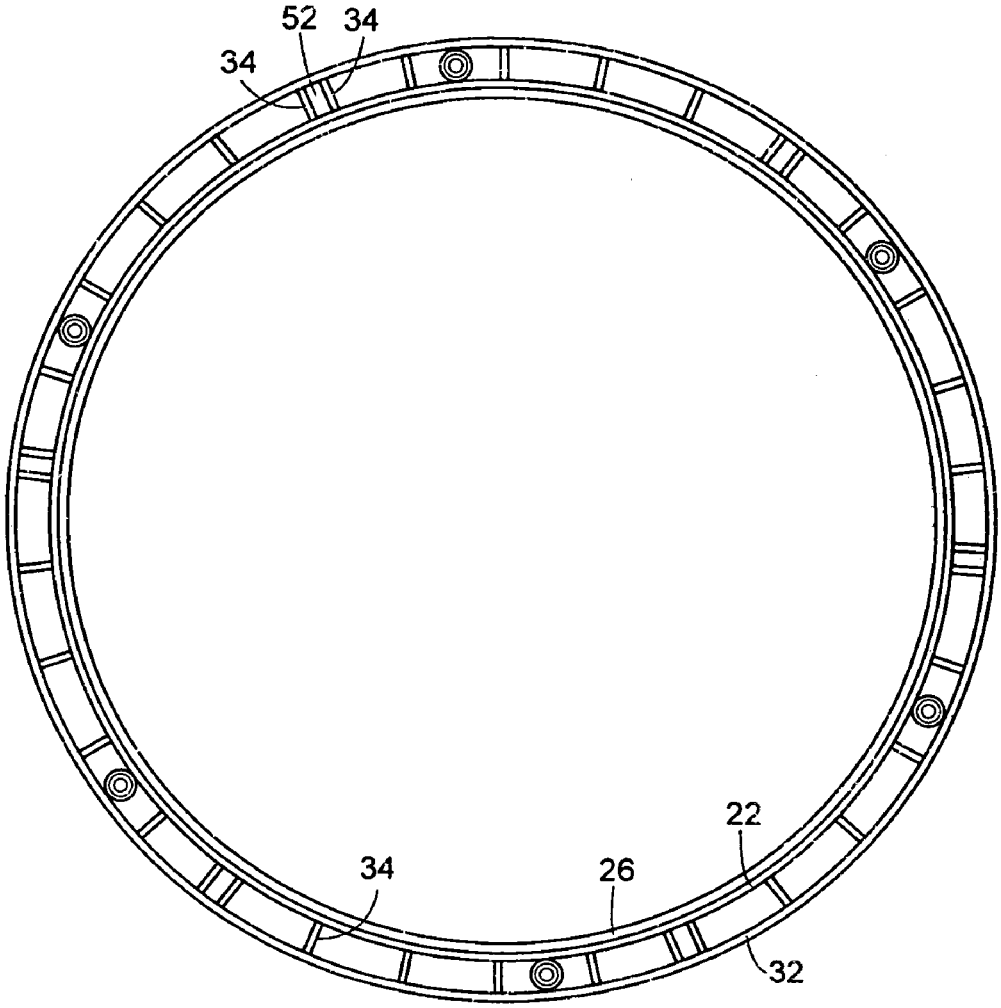
FIG. 5 is a top plan view of a multi-use adapter ring of the present disclosure.
Figure 5A:
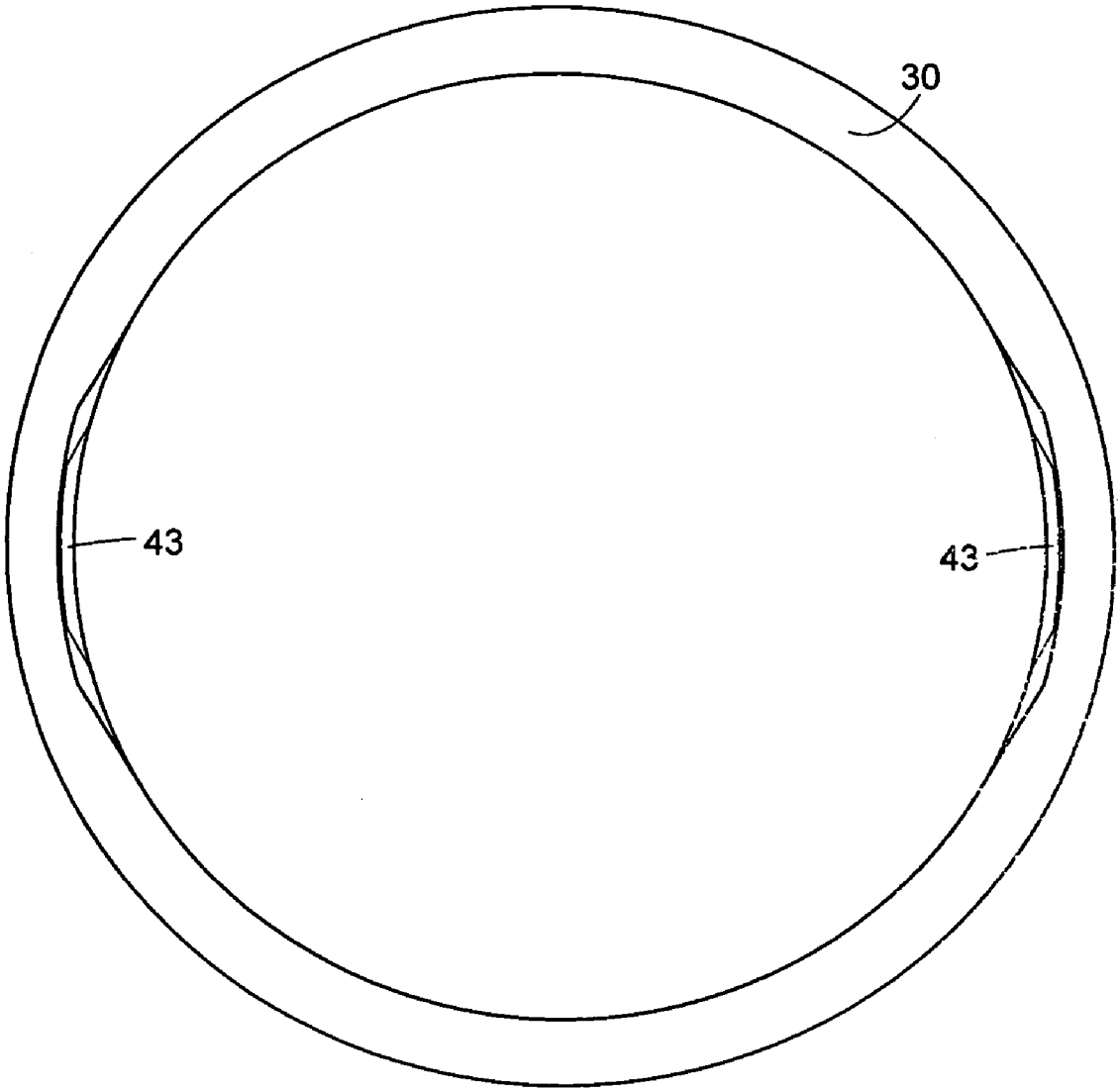
FIG. 5A is a bottom plan view of a first embodiment of the multi-use adapter ring shown in FIG. 5.
Figure 5B:
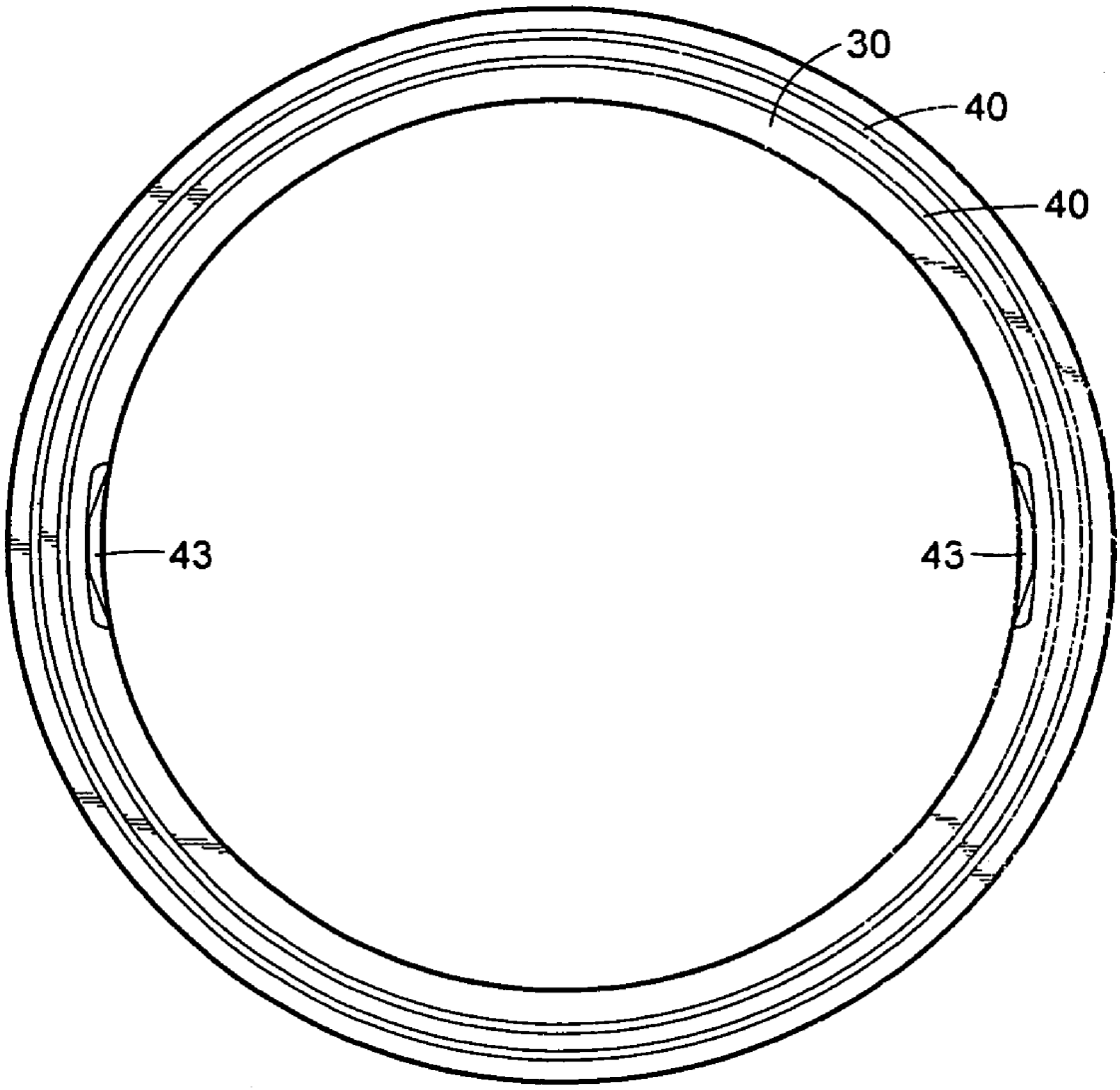
FIG. 5B is a bottom plan view of a second embodiment of the multi-use adapter ring shown in FIG. 5.

The bottom 30 of the multi-use adapter ring 10 may be grooveless, as shown in FIG. 5A, or may have one or more cylindrical grooves 40 therein, as shown in FIG. 5B. The grooves 40 provide greater surface area of the multi-use adapter ring 10 to receive an adhesive material, such as butyl mastic, to facilitate adhesion of the multi-use adapter ring 10 to an exposed surface of an underlying component, such as a concrete lid 42 of a septic tank. The bottom 30 of the multi-use adapter ring 10 may also have one or more recessed areas 43. These recessed areas 43 are formed as a result of a gas assist technique employed in creating one or more gas channels under the inner ledge 26 during injection molding of the multi-use adapter ring 10. Employing gas assist techniques in the molding of the multi-use adapter ring 10 provides dimensional stability and helps to maintain the desired flat-bottomed shape of multi-use adapter rings 10 during their manufacture, when shrinkage can otherwise distort their shape. Gas assist molding techniques also give the multi-use adapter rings significant strength for the amount of plastic material used in their manufacture.

Figure 2:
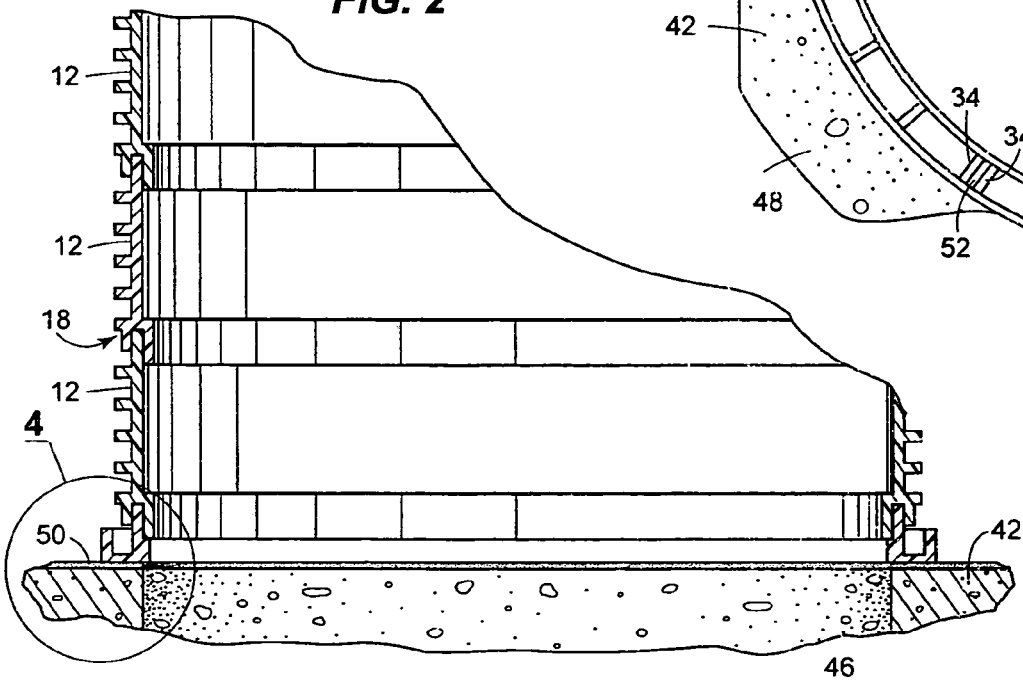
FIG. 2 is a cross-section view taken along lines 2-2 of FIG. 1, and showing in cross-section additional risers received on the lowermost riser.
Figure 4:
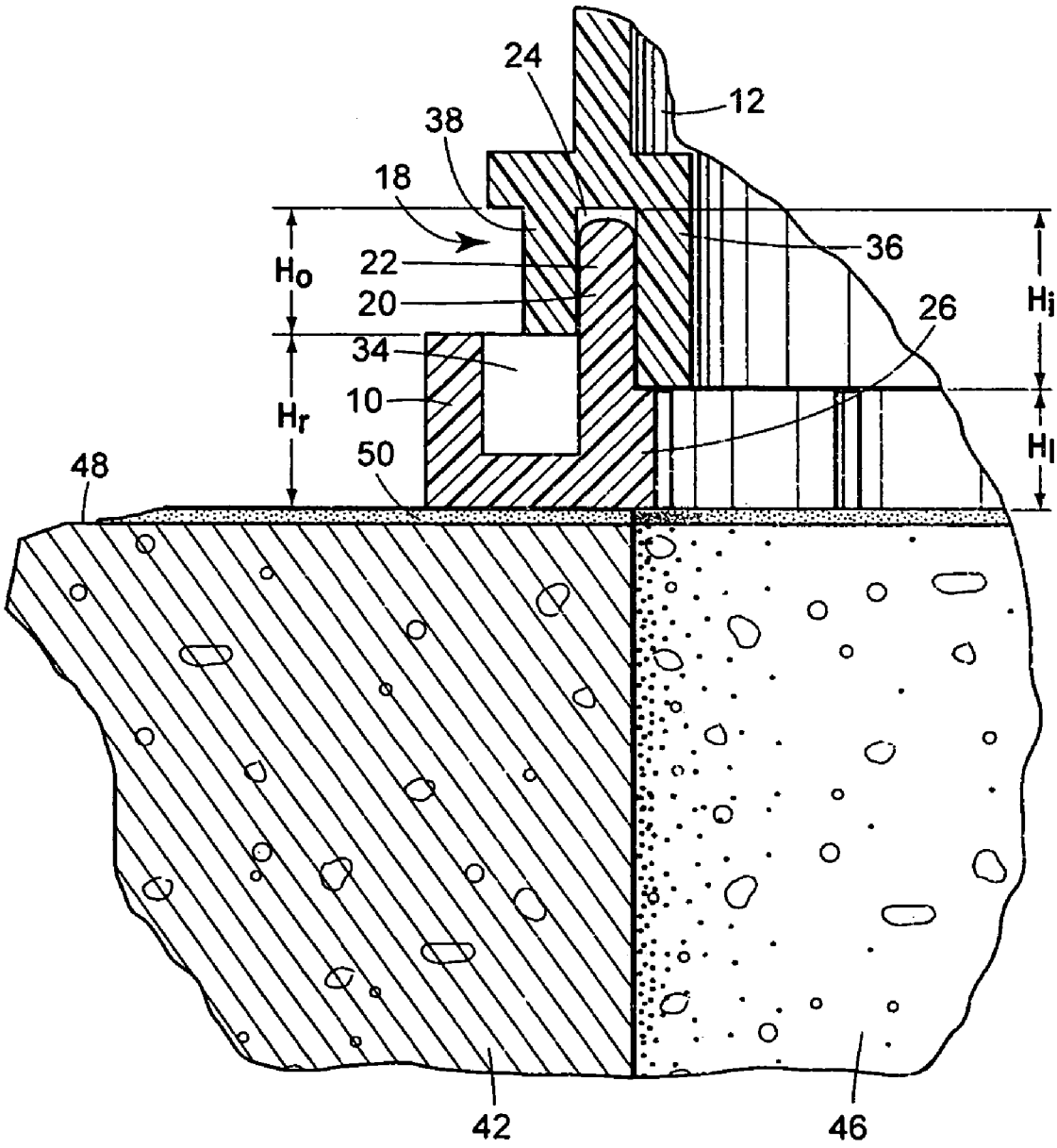
FIG. 4 is an enlarged view of the region of FIG. 2 within the circled area designated by the number 4.
Figure 6:
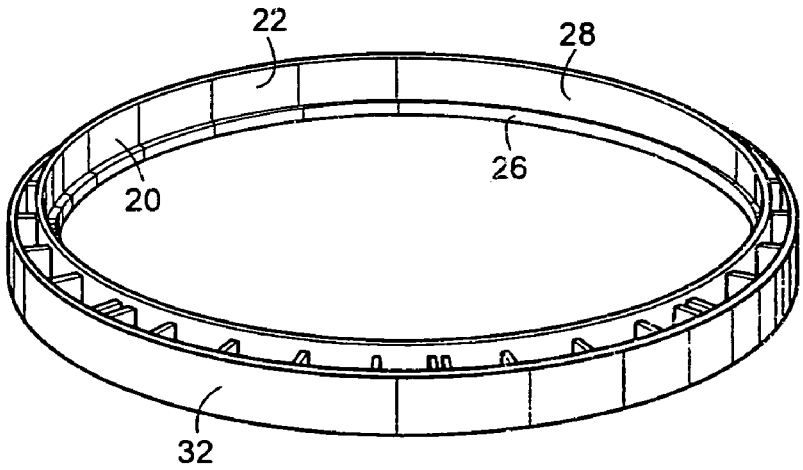
FIG. 6 is a perspective view of the multi-use adapter ring shown in FIG. 5.

Turning to FIGS. 1-4, a multi-use adapter ring 10 is shown on a concrete lid 42 of a septic tank 44. The septic tank 44 has an access opening 46 therein. The multi-use adapter ring 10 is sealed to a flat surface 48 on the concrete lid 42 using a suitable adhesive 50, such as butyl mastic. A lowermost riser 12 having a female connection end 18 is received on the multi-use adapter ring 10. As shown in FIG. 2, an additional riser 12 having a similar female connection end 18 is received on the lowermost riser 12, and yet another riser 12 is received on that additional riser 12, forming a stack of risers.

At least some of the radially-extending ribs 34 of the multi-use adapter ring 10 are arranged in close proximity to adjacent ribs 34, forming a gap 52 of approximately 5 mm between the ribs 34. Each of these gaps 52 receives a threaded fastener 54 which extends through a screw boss or aperture provided at the female connection end 18 of the lowermost riser 12, with the threads of the threaded fastener 54 cutting into the ribs 34 on either side of the gap 52, thereby securing the lowermost riser 12 to the multi-use adapter ring 10. Instead or in addition, adhesive (not shown), such as butyl mastic, may be applied to a top of the vertical cylindrical wall 22 of the multi-use adapter ring 10, or to the interior of the inverted, generally U-shaped cylindrical channel 24 of the female connection end 18 of the lowermost riser 12.

Figure 7:
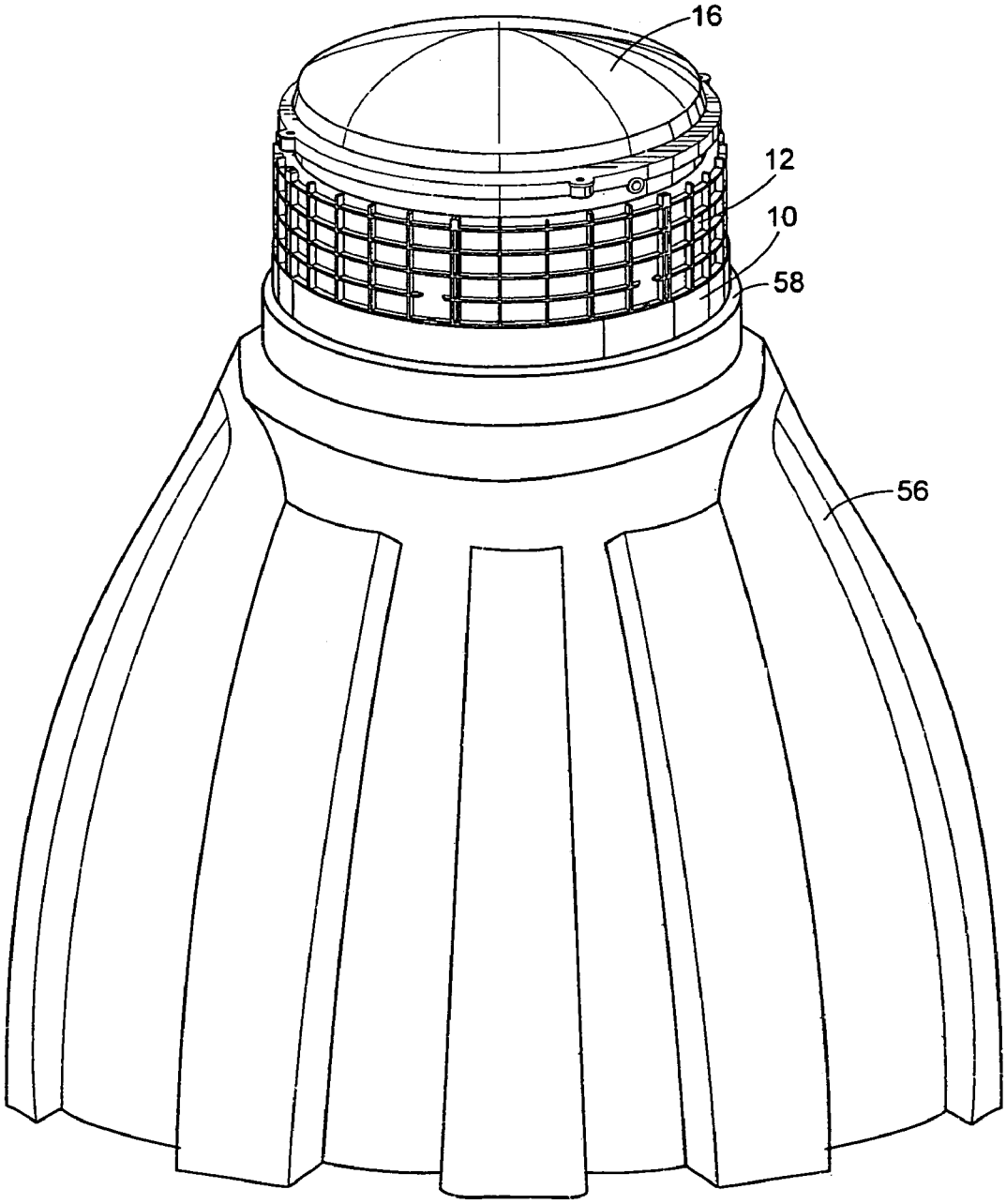
FIG. 7 is a front perspective view of a multi-use adapter ring of the present disclosure disposed at a top of a plastic septic tank, broken away, with a riser received on the adapter ring and a riser cover received on the riser.
Figure 7A:
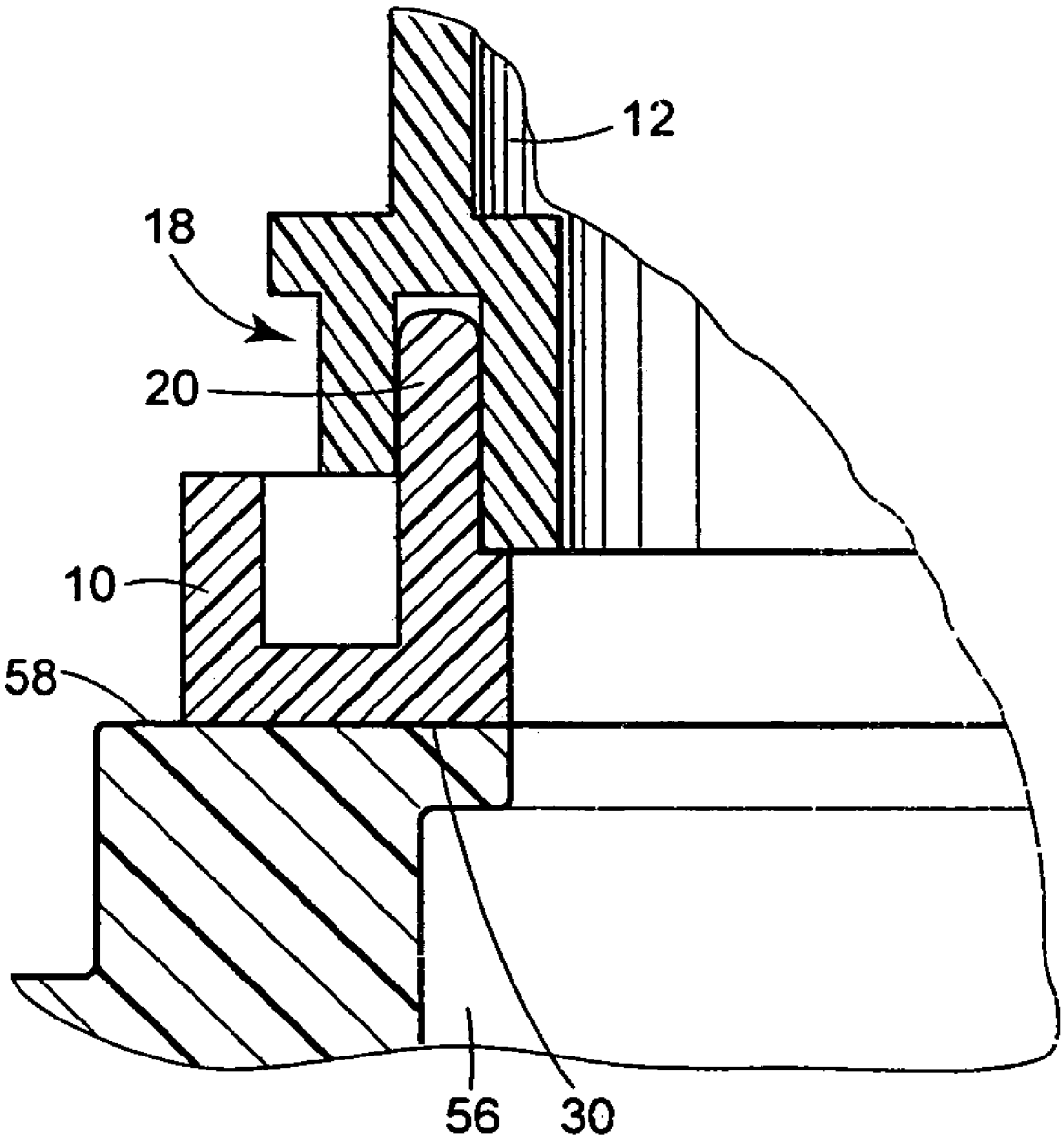
FIG. 7A is an enlarged cross-section view similar to FIG. 4, but showing the intersection of the top of the plastic septic tank, the multi-use adapter ring, and the riser of FIG. 7.

Turning to FIGS. 7-7A, the multi-use adapter ring 10 is shown at an access opening of a plastic tank 56. The plastic tank 56 has an exposed flat surface 58, and the bottom 30 of the multi-use adapter ring 10 is adhered (using a suitable adhesive, not shown) to the exposed flat surface 58. A riser 12 is received on the multi-use adapter ring 10, with the female connection end 18 of the riser 12 mating with the male cylindrical connecting portion 20 of the multi-use adapter ring 10. A riser cover 16 is provided on the riser 12.

Figure 8:
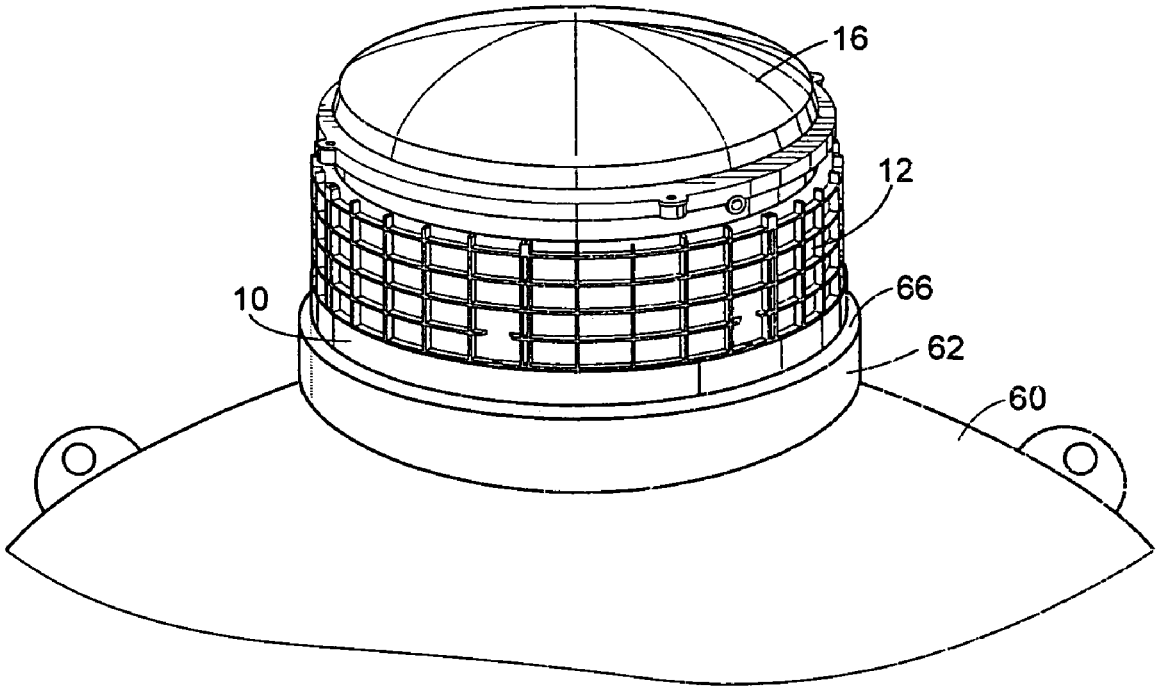
FIG. 8 is a front perspective view of a multi-use adapter ring of the present disclosure disposed at a top of a plastic septic tank, broken away, having an alternate shape to that shown in FIG. 7, with a riser received on the adapter ring and a riser cover received on the riser.
Figure 8A:
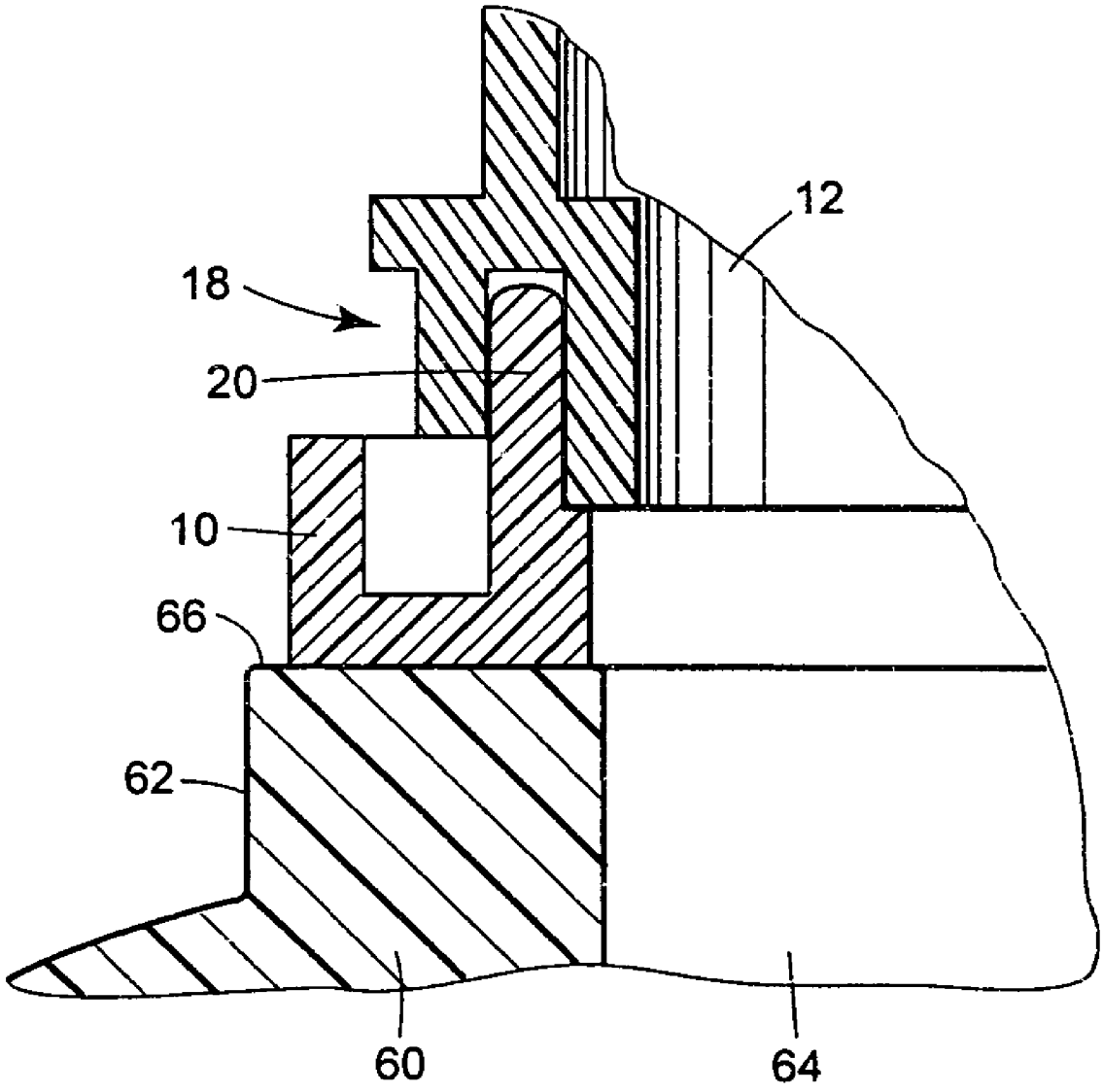
FIG. 8A is an enlarged cross-section view similar to FIG. 7A, but showing the intersection of the top of the plastic septic tank, the multi-use adapter ring, and the riser of FIG. 8.

FIGS. 8-8A show the multi-use adapter ring 10 at an access opening of a plastic tank 60 having a shape different from the plastic tank 56 shown in FIG. 7. The plastic tank 60 of FIG. 8 has a raised cylindrical port 62 about an access opening 64. The raised cylindrical port 62 has an exposed flat surface 66. As best shown in FIG. 8A, the bottom 30 of the multi-use adapter ring 10 is received on the exposed flat surface 66. An appropriate adhesive (not shown) is used to seal the bottom 30 of the multi-use adapter ring 10 to the exposed flat surface 66. A riser 12 is received on the multi-use adapter ring 10, with the female connection end 18 of the riser 12 mating with the male cylindrical connection portion of the multi-use adapter ring 10.

Figure 9:
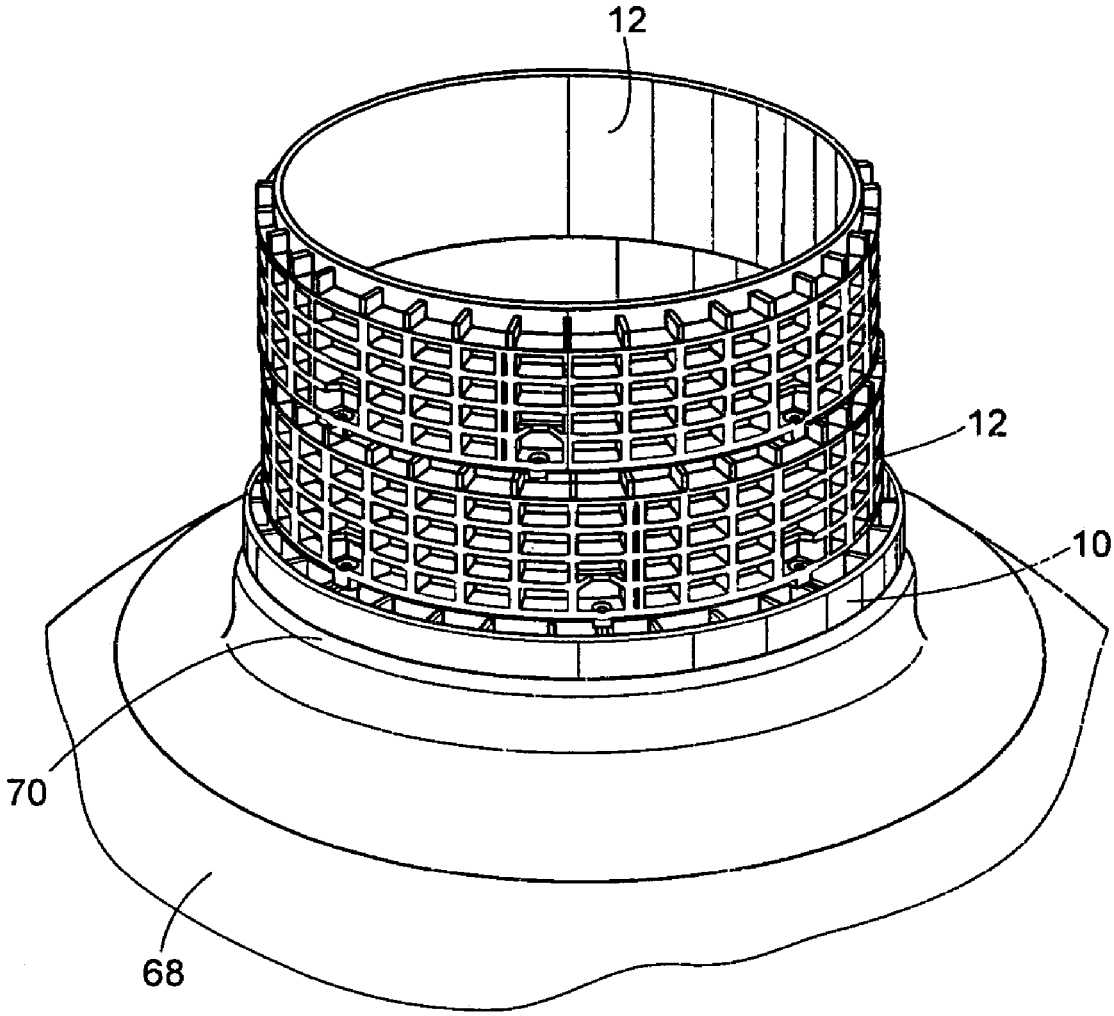
FIG. 9 is a perspective view of a multi-use adapter ring of the present disclosure disposed at a top of a plastic septic tank, broken away, having an alternate shape to those shown in FIGS. 7 and 8, with a lowermost riser of a stack of risers received on the adapter ring, and a second riser received on the lowermost riser.

As illustrated in FIG. 9, the multi-use adapter ring 10 may be provided on yet another type of tank 68, provided the tank 68 has an exposed flat surface 70. Once the multi-use adapter ring 10 is secured to the exposed flat surface 70 using an appropriate adhesive (not shown), the tank 68 is rendered compatible with riser components such as a lowermost riser 12 of a stack of risers. In FIG. 9, a second riser 12 is shown to be received on the lowermost riser 12. The tank 68 may be made of plastic, or alternatively, may be a fiberglass construction.

Figure 10:
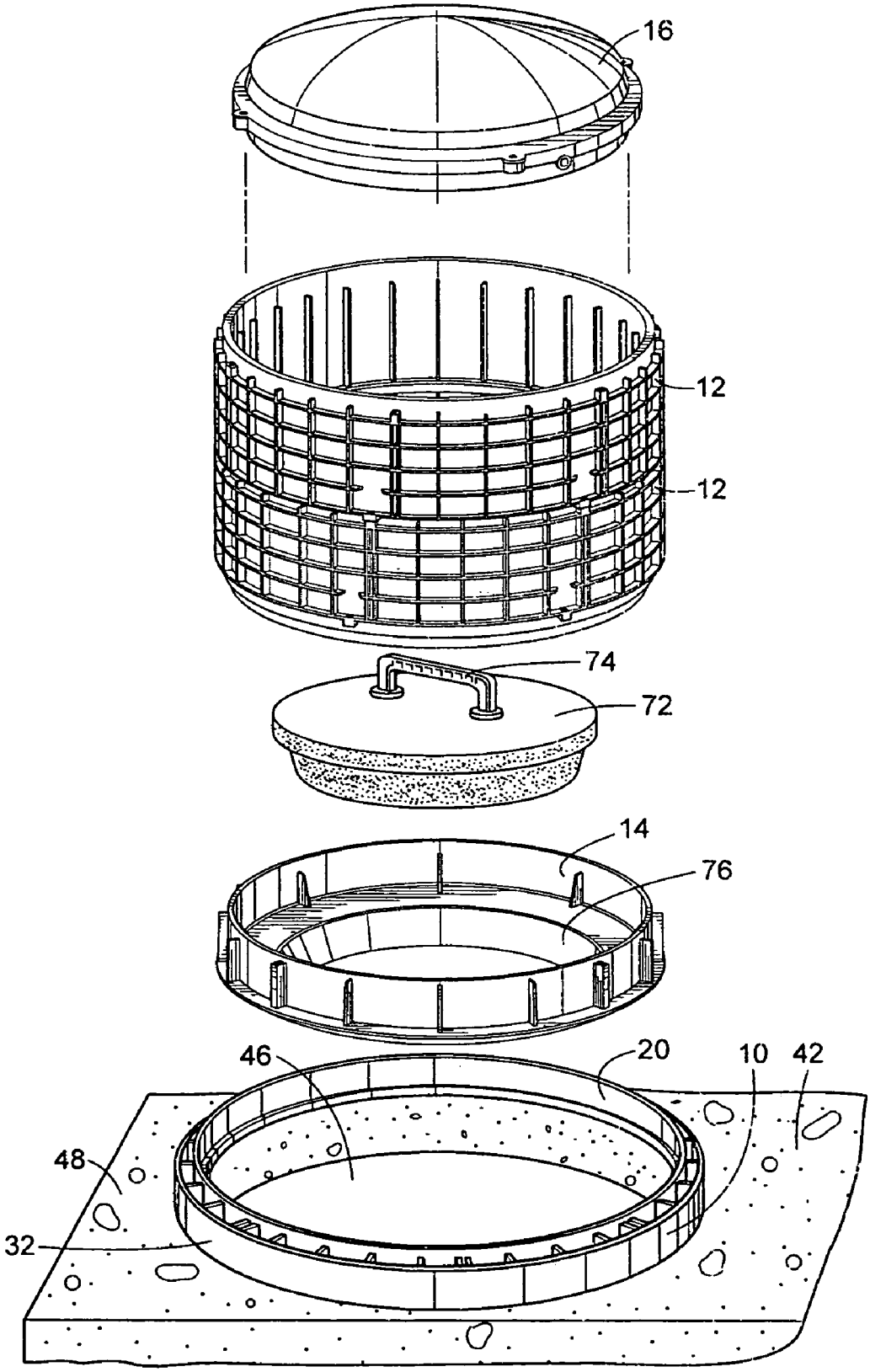
FIG. 10 is a partially exploded view of a multi-use adapter ring of the present disclosure disposed on a concrete lid of a septic tank, in combination with a riser pan, a secondary cover to be received in a frustro-conical portion of the riser pan, a pair of risers the lowermost of which is to be received on the adapter ring, and a riser cover to be received on the upper riser.

In FIG. 10, the multi-use adapter ring 10 is shown as used on a concrete lid 42 of a septic tank, which is broken away. The multi-use adapter ring 10 renders the concrete lid 42 compatible with riser components such that an installer may arrange riser components in a multitude of desired combinations. For instance, as shown in FIG. 10, a riser pan 14 may be received on the vertical cylindrical wall 22 of the multi-use adapter ring 10. A supplemental cover 72, such as a concrete cover having a handle 74, may be received in a frustro-conical portion 76 of the riser pan 14. The riser pan 14 can then receive a lowermost riser 12 thereon. Additional risers 12 may then be received, successively, on the lowermost riser 12, so as to extend up to a desired elevation (e.g., grade level) a passageway to the supplemental cover 72 and the access opening 46 of the tank. Finally, a riser cover 16 may be provided on an uppermost riser 12, and secured to the uppermost riser.

Figure 11:
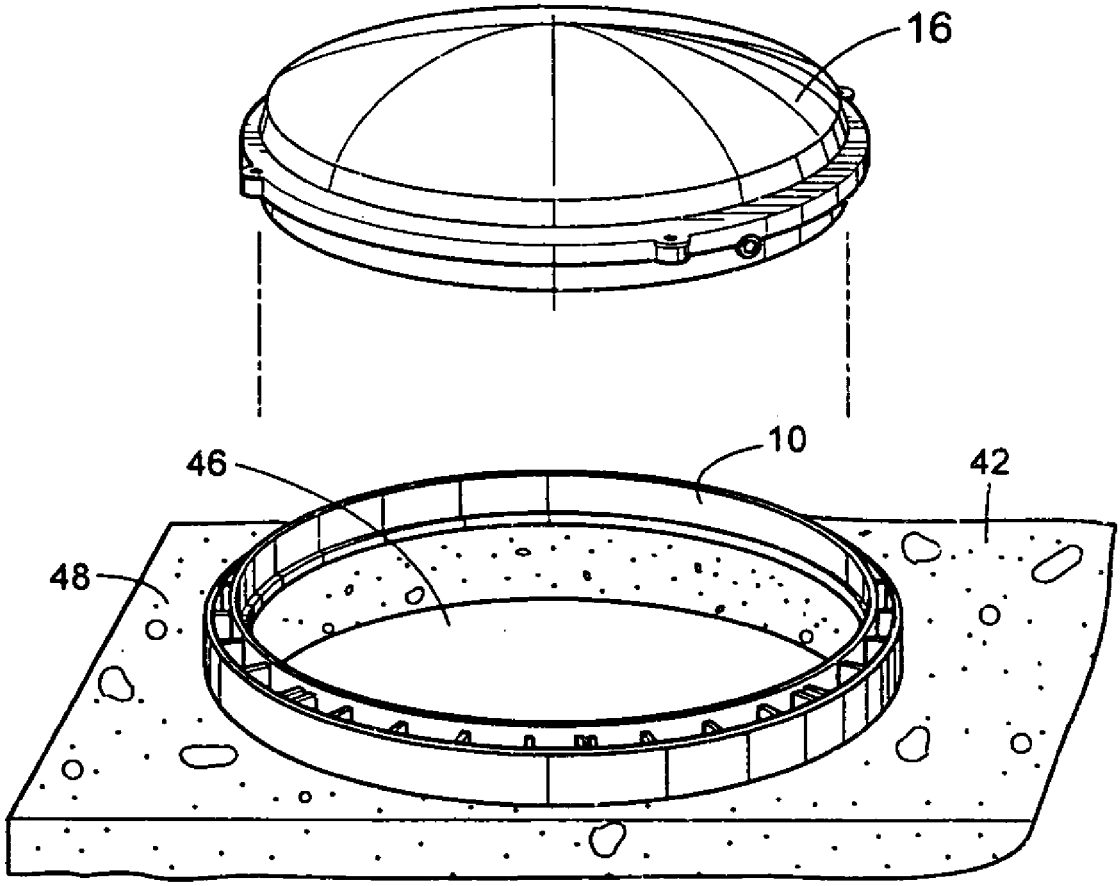
FIG. 11 is a partially exploded view of a multi-use adapter ring of the present disclosure disposed on a concrete lid of a septic tank, with a riser cover to be received directly on the adapter ring.

Turning to FIG. 11, yet another arrangement of riser components is shown. In this figure, only a single riser component, namely a riser cover 16, is used with the multi-use adapter ring 10. This combination may be desired, for instance, where the concrete lid 42 of a septic tank is located just below grade level. Alternatively, where access to a particular access opening 46 of a septic tank buried deep below grade level is not needed, this combination permits that access opening 46 to be sealed by the riser cover 16, which may then be buried.

Figure 12:
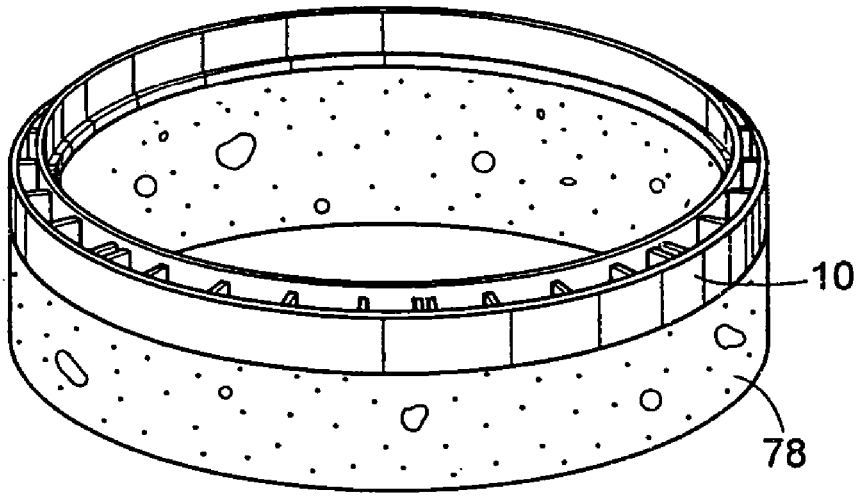
FIG. 12 is a perspective view of a multi-use adapter ring of the present disclosure disposed on a concrete riser.
Figure 12A:
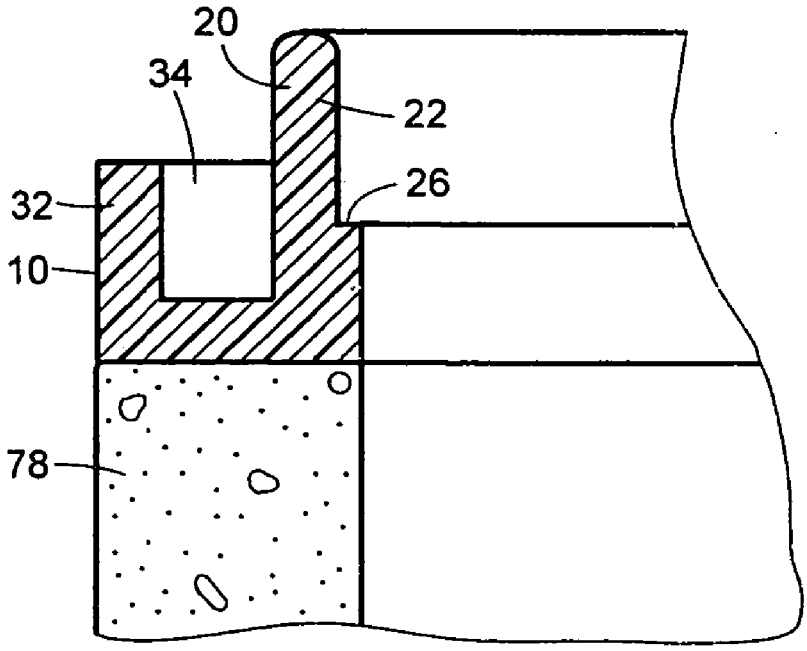
FIG. 12A is a cross-section of an intersection between the multi-use adapter ring and the concrete riser of FIG. 12.
Figure 13:
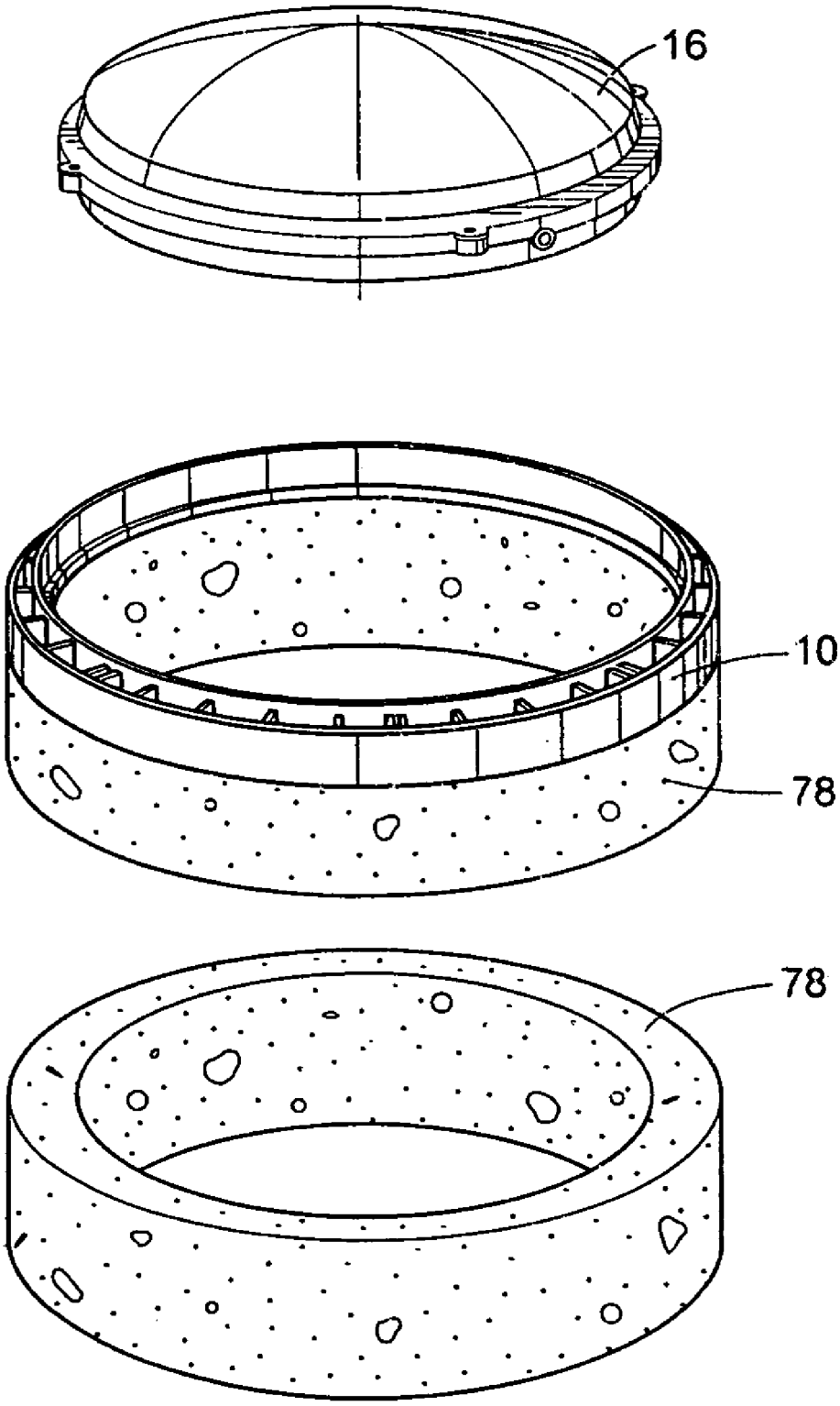
FIG. 13 is a partially exploded view of a lower concrete riser, an upper concrete riser having a multi-use adapter ring of the present disclosure disposed thereon, and a riser cover to be received directly on the adapter ring.

FIGS. 12-12A show a multi-use adapter ring 10 received on a concrete riser 78. The benefit of this use of the adapter ring 10 is that a concrete riser 78, which conventionally has very little versatility, is made compatible with various lightweight substantially water-tight and substantially vacuum-tight riser components received on the adapter ring 10. FIG. 13 is a partially exploded view, showing a pair of concrete risers 78, with the multi-use adapter ring 10 received on the uppermost concrete riser 78, and a riser cover to be received on the male cylindrical connecting portion 20 of the adapter ring 10.

Figure 14:
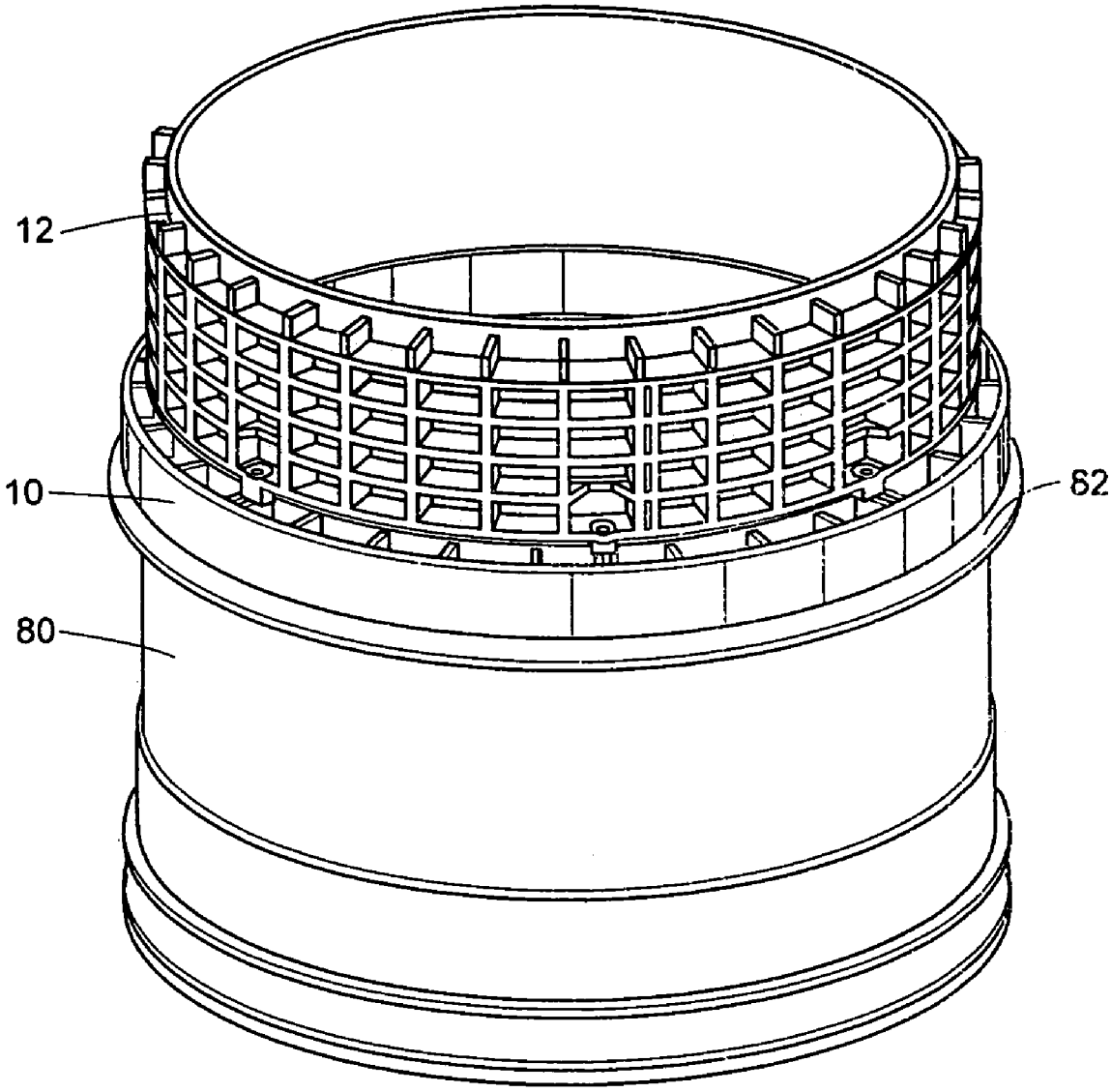
FIG. 14 is a perspective view of a multi-use adapter ring of the present disclosure disposed on a riser having a flat top surface, and a riser received on the adapter ring.
Figure 14A:
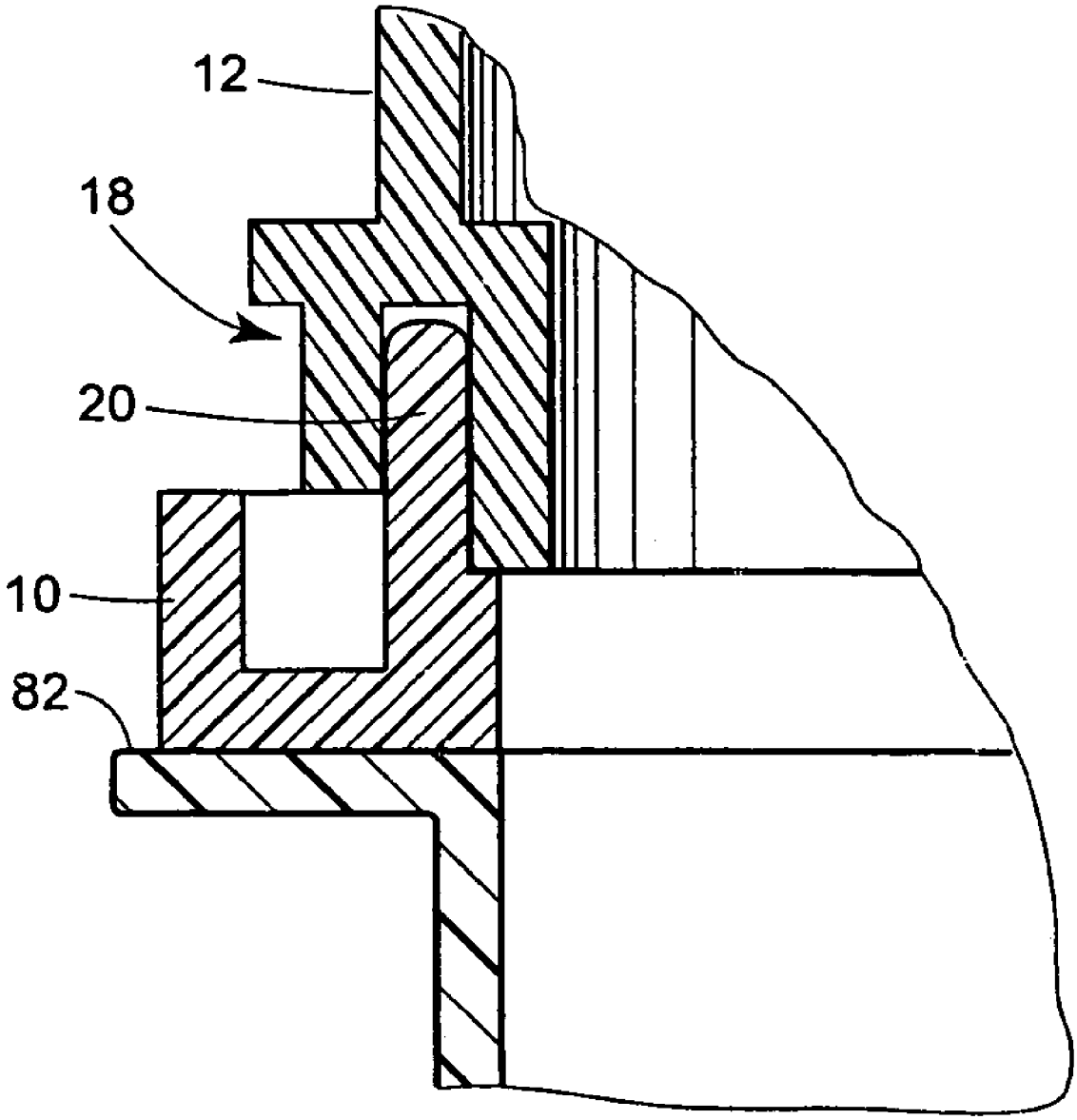
FIG. 14A is an enlarged cross-section of FIG. 14 similar to FIG. 7A, but showing the intersection of the top of the riser having a flat top surface, the multi-use adapter ring, and the riser of FIG. 14.

FIGS. 14-14A show the multi-use adapter ring 10 used to convert a plastic riser 80 having an exposed flat surface 82 for use in combination with substantially water-tight, substantially vacuum-tight interconnecting riser components. A riser 12 is received on the multi-use adapter ring 10, with the female connection end 18 of the riser 12 mating with the male cylindrical connection portion 20 of the multi-use adapter ring 10.

Figure 15:
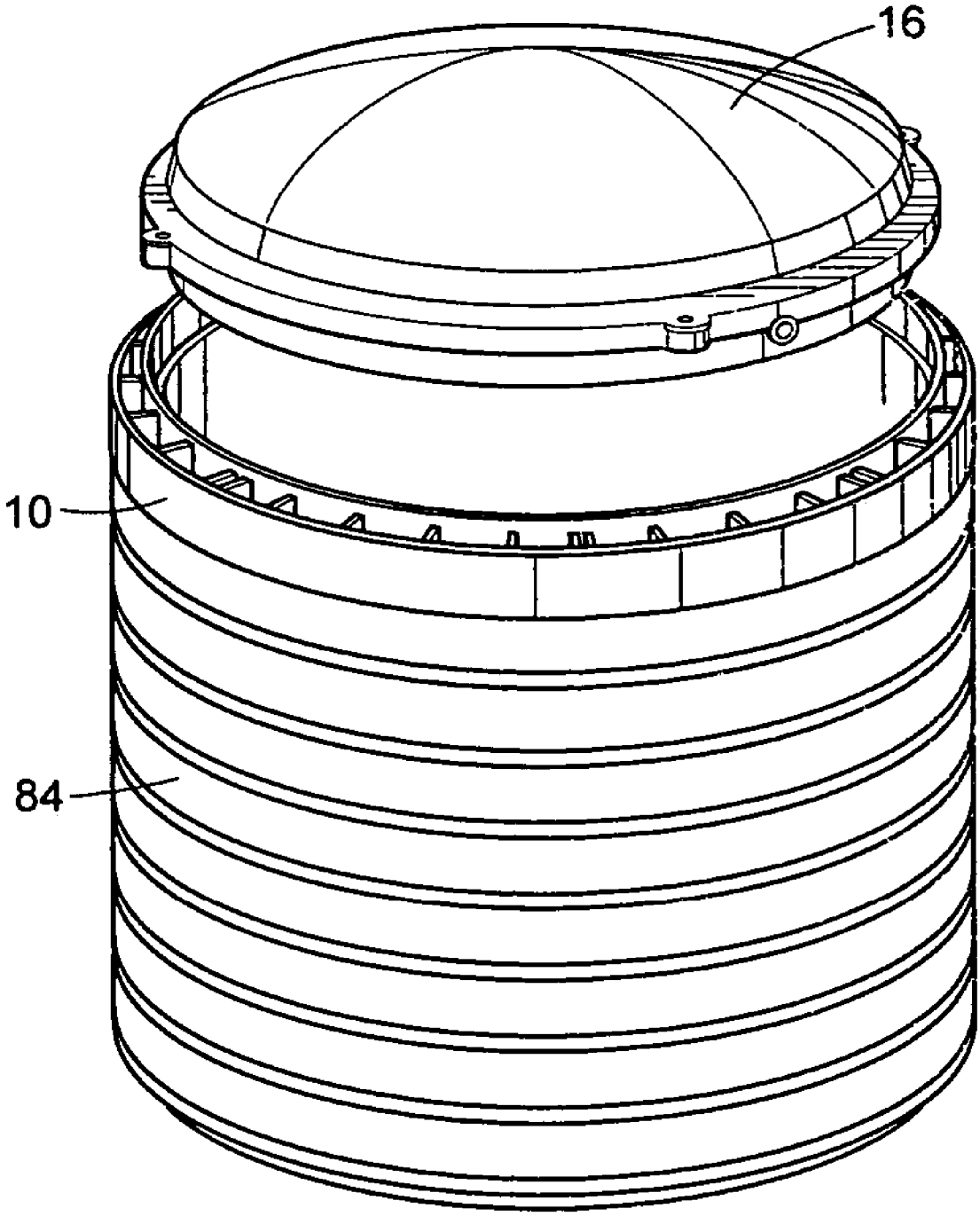
FIG. 15 is a partially exploded perspective view of a multi-use adapter ring of the present disclosure disposed on a length of corrugated pipe, and a riser received on the adapter ring.
Figure 15A:
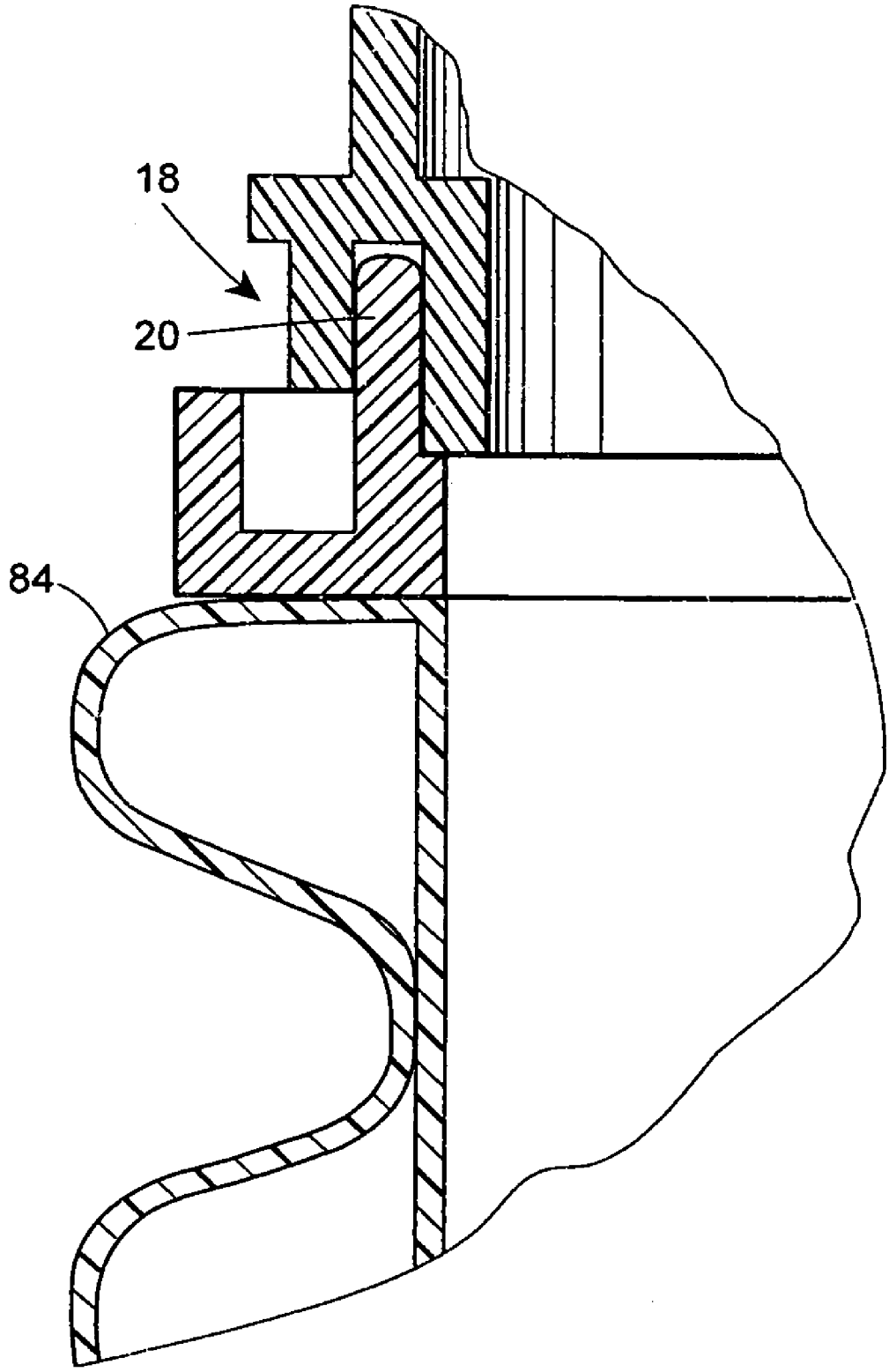
FIG. 15A is an enlarged cross-section of FIG. 15 similar to FIG. 14A, but showing the intersection of the top of the corrugated pipe, the multi-use adapter ring, and the riser of FIG. 15.

Yet another use for the multi-use adapter ring 10 is shown in FIGS. 15-15A. In those figures, the multi-use adapter ring 10 is shown as used on a length of ribbed PVC pipe 84. A riser component, such as a riser cover 16, is received on the male cylindrical connecting portion 20 in the manner described above. The adapter ring 10, as sealed to the ribbed PVC pipe 84, renders the ribbed PVC pipe 84 compatible with substantially water-tight, substantially vacuum-tight interconnecting riser components.

While certain embodiments of a multi-use adapter ring have been disclosed, it will be understood that variations may be made that are still within the scope of the appended claims.

I claim:

1. An adapter ring for converting compatibility of an exposed flat surface surrounding an access opening to be usable with riser components that are engageable in a substantially vacuum-tight manner, comprising:

a substantially flat cylindrical bottom sealably securable to a flat surface surrounding an access opening;

a first vertical cylindrical wall extending upward from the cylindrical bottom;

a second vertical cylindrical wall extending upward from the cylindrical bottom and spaced radially outwardly from the first vertical cylindrical wall, said second vertical cylindrical wall having a height less than the height of the first vertical cylindrical wall; and a plurality of radially-extending ribs disposed between the first and second vertical cylindrical walls.

2. The adapter ring of claim 1, wherein the plurality of radially-extending ribs are no higher than the height of the second vertical cylindrical wall.

3. The adapter ring of claim 1, wherein the cylindrical bottom of the adapter ring has one or more grooves therein.

4. The adapter ring of claim 1, in combination with a riser component having a female connection end including an inverted, generally U-shaped cylindrical channel having an outer leg received on the plurality of radially-extending ribs.

5. The adapter ring of claim 4, wherein the riser component is selected from a group of a riser, a riser pan, and a riser cover.

6. The adapter ring of claim 1, wherein at least one of the radially-extending ribs is arranged in close proximity to an adjacent one of the radially-extending ribs, forming a gap therebetween to selectively securely receive a threaded fastener.

7. The adapter ring of claim 6, wherein the gap is about 5 mm.

8. The adapter ring of claim 1, further including an inner ledge formed inwardly of the first vertical cylindrical wall, and a top surface of the inner ledge being spaced from a top of the first vertical cylindrical wall.

9. The adapter ring of claim 8, in combination with a riser component having a female connection end including an inverted, generally U-shaped cylindrical channel having an inner leg received on the inner ledge.

10. The adapter ring and riser component combination of claim 9, wherein the generally U-shaped cylindrical channel further includes an outer leg received on the plurality of radially-extending ribs.

11. The adapter ring of claim 8, in combination with a riser component having a female connection end including an inverted, generally U-shaped cylindrical channel having an outer leg received on the plurality of radially-extending ribs.

12. In combination, a lid of a tank having an access opening therein and an exposed flat surface surrounding the access opening;

an adapter ring having a flat bottom, a first vertical cylindrical wall extending up from the bottom, a second vertical cylindrical wall extending up from the bottom and spaced radially outward from the first vertical cylindrical wall, and a plurality of radially-extending ribs disposed between the first and second vertical cylindrical walls, the first vertical cylindrical wall having a greater height than the radially-extending ribs, said bottom of the adapter ring adhered to the exposed flat surface of the lid of the tank; and a riser component having a female connection end at a lower portion thereof, said female connection end receiving at least a portion of the first vertical cylindrical wall.

13. The combination of claim 12, and wherein the female connection end of the riser component includes an inverted, generally U-shaped cylindrical channel including an outer leg supported by the plurality of radially-extending ribs.

14. The combination of claim 12, and wherein the adapter ring includes an inner ledge extending from an inner surface of the first vertical cylindrical wall, and the female connection end of the riser component includes an inverted, generally U-shaped cylindrical channel including an inner leg supported by the inner ledge.

15. The combination of claim 12, wherein the riser component is a riser cover.

16. The combination of claim 12, wherein the riser component is a riser.

17. The combination of claim 16, in further combination with an additional riser component received on the riser.

18. The combination of claim 12, wherein the riser component is a riser pan.

19. The combination of claim 12, wherein the riser component is a lowermost riser component, and in further combination with at least one additional riser component received on the lowermost riser component.

20. An adapter ring for connecting a riser component to an exposed flat surface surrounding an access opening of a tank, the adapter ring comprising:

a generally planar bottom;

a first vertical cylindrical wall extending upwardly from the bottom, a top of the first cylindrical wall defining a male connection end of the adapter ring;

a second vertical cylindrical wall extending upwardly from the bottom, the second vertical cylindrical wall having a height less than a height of the first vertical cylindrical wall; and a plurality of radially-extending ribs between the first and second vertical cylindrical walls.

* * * * *